US005632548A

United States Patent [19]

Mayfarth

[11] Patent Number: 5,632,548

[45] Date of Patent: May 27, 1997

[54] PRESSURE ACTUATED LIGHT WITH DIGIT ACCOMMODATING HOUSING MEANS

[76] Inventor: Roger C. Mayfarth, 533 Birchwood Rd., Linden, N.J. 07036

[21] Appl. No.: 543,177

[22] Filed: Oct. 12, 1995

[51] Int. Cl.[6] ..... F21L 15/08

[52] U.S. Cl. ..... 362/103; 362/189; 362/204

[58] Field of Search ..... 362/103, 186, 362/189, 190, 191, 203, 204, 205; 200/60

[56] References Cited

U.S. PATENT DOCUMENTS

| | | | |
|---|---|---|---|
| 914,975 | 3/1909 | Radley . | |
| 993,251 | 5/1911 | Howard . | |
| 4,422,131 | 12/1983 | Clanton et al. | 362/186 |
| 5,124,892 | 6/1992 | Lambert | 362/103 |
| 5,188,447 | 2/1993 | Chiang et al. | 362/103 |
| 5,226,712 | 7/1993 | Lucas | 362/103 |
| 5,283,722 | 2/1994 | Koenen et al. | 362/103 |
| 5,381,615 | 1/1995 | MacMillan | 36/137 |
| 5,450,293 | 9/1995 | Hoffman | 362/103 |
| 5,535,105 | 7/1996 | Myers et al. | 362/103 |

*Primary Examiner*—Ira S. Lazarus
*Assistant Examiner*—Alfred Basichas
*Attorney, Agent, or Firm*—Klauber & Jackson

[57] ABSTRACT

There is provided a pressure actuated light comprising a housing means having an open end into which a human digit can be inserted, and a closed end adapted to transmit light; and an illuminating system located proximally to said closed end, comprising a light source, e.g., LED, adjacent said closed end; a battery, e.g., alkaline or NiCd, to provide electrical power to said light source; means for making a permanent electrical connection between said light source and a terminal of said battery; and actuating means comprising a conductor means with one end thereof having a permanent electrical connection to the opposite terminal of said light source, and with the opposite end or intervening portion thereof located proximally to the corresponding opposite terminal of said battery, whereby said conductor means, in cooperation with said inserted human digit and said housing means, is capable of making an intermittent and interruptible electrical connection between said opposite terminal of said light source and said corresponding opposite terminal of said battery. The pressure actuated light is especially useful in the presentation of performances by magicians, where the housing means is preferably a substantially hollow single piece molded from a material so as to closely resemble a human thumb, wherein by applying a slight pressure with the index and second fingers to the tip of the thumb, the illuminating system is activated and the LED emits light, e.g., red, through the thumb. By releasing this slight pressure, the light goes off. Thus, the magician, by simulating a plucking action with his or her hand, will appear to be plucking a light out of thin air, or from any place which the magician desires.

20 Claims, 1 Drawing Sheet

PRESSURE ACTUATED LIGHT WITH DIGIT ACCOMMODATING HOUSING MEANS

FIELD OF THE INVENTION

The present invention is in the field of lighting devices which are actuated by pressure from or contact with some part of the human body. In particular, the present invention is concerned with such lighting devices where the pressure or contact is from a human digit, especially where the lighting device is housed in means which will accommodate that digit, so that it is possible to illuminate an object or area with the light source contained in the device in a desired fashion and for a desired length of time, without requiring the application substantial pressure.

BACKGROUND OF THE INVENTION

Lighting devices which are actuated by pressure from or contact with some part of the human body have long been used for a variety of purposes. Such applications have included in particular illuminating means for various theatrical displays and performances.

U.S. Pat. No. 993,251 to Howard discloses a support adapted for a human theatrical performance, such as a tight-rope, having sections of electrical contacts so arranged that the movements of the performer will make and break connections between lights placed on the performer's clothing, person or performance apparatus. The sections of electrical contacts comprise wires arranged in alternating sections and extend from opposite sides of a source of electricity. The electrical circuit is completed when the performer, wearing heal and toe contacts mounted on a non-conducting overshoe, bridges the space between any of the alternating sections. The circuit is completed through the source of electricity, and the lights connected to the tips on that particular foot become illuminated.

Another application has been to provide a source of illumination which may be readily attached to and held upon a digit of the human hand in a position to throw light upon any object or objects which it may be desired to see without interfering with the use of the hands and of the thumb and fingers of each hand.

U.S. Pat. No. 914,975 to Radley discloses a portable electric lamp attached to the thumb of the left hand and connected by a flexible conductor cord with a battery slung from the shoulder. Completion of the electrical circuit is by means of a lapped metal ring placed around the user's thumb and secured to the light housing means, and a contact spring attached to and insulated from the light housing means, which extends partially around and underneath the metal ring, terminating in a contact point. When the lapped ring is placed on the user's thumb and the contact spring is pressed against anything held in the hand or against the opposing finger, it is forced into contact with the ring and the circuit is closed between the lamp and battery.

U.S. Pat. No. 5,124,892 to Lambert discloses a night vision illuminating device, especially for use in the cockpit of an aircraft utilizing a night vision imaging system, comprising a self-contained electrical power source located within a small housing means arranged to be releasably secured onto a finger of the pilot. Manually actuatable means comprise switches provided on both sides of the device so that it can be worn on either the right or left hand, with the other hand having access to the switch of the side closest to the other hand. The device is secured onto the finger by means of an elongated fastening tape adhesively secured to the housing means, the outer surface of said fastening tape having a plurality of hook fasteners and the inner surface having a plurality of loop fasteners.

U.S. Pat. No. 4,422,131 to Clanton and Simmons discloses a lighting device in the configuration of a human finger and adapted to be worn as an extension of the human finger. It is activated by forcing the finger into contact with a light source that is supported within the tip of the housing means structure. Particularly, the finger is inserted into the open end of the housing means and is forced into contact with a battery; continued movement of the finger overcomes the force of a spring, causing the battery terminal to come into contact with a bulb contact, completing an electrical circuit, and thereby providing power to the bulb, causing it to glow. Alternatively, the finger is inserted only far enough to contact the battery, and activation of the light is accomplished by placing the closed end of the housing means into contact with a firm surface, against which the finger is then pressed, causing the bulb contact to come into contact with the battery terminal, as in the first alternative.

Still further applications have involved different parts of the human body, with different activating mechanisms and different lighting objectives.

U.S. Pat. No. 5,226,712 to Lucas discloses a hands-free flashlight adapted to be held in a user's mouth, particularly between the upper and lower teeth, so as to direct a beam of light in a desired direction while enabling the use of both hands to perform a particular task. The switch means are structured to be operated between an open and closed position by a biting force exerted by the user's teeth.

U.S. Pat. No. 5,188,447 to Chiang and Ratcliffe discloses an illuminating system comprising an insert attached to the heel of a shoe to provide an illumination every time that the heel of the shoe contacts the ground when the wearer of the shoe is walking, jogging or running, in order that these activities may take place safely under all possible combinations of adverse conditions. A piezoelectric member disposed in the insert produces a signal when the insert is impacted against an object, and this signal is amplified by an amplifier powered by a battery.

U.S. Pat. No. 5,381,615 to MacMillan discloses footwear incorporating a lighting circuit including a pair of pressure responsive switches for controlling the supply of power to the lighting element through a condition responsive logic circuit, whereby the battery life is improved without the necessity for a timing circuit.

SUMMARY OF THE INVENTION

Figure 1:
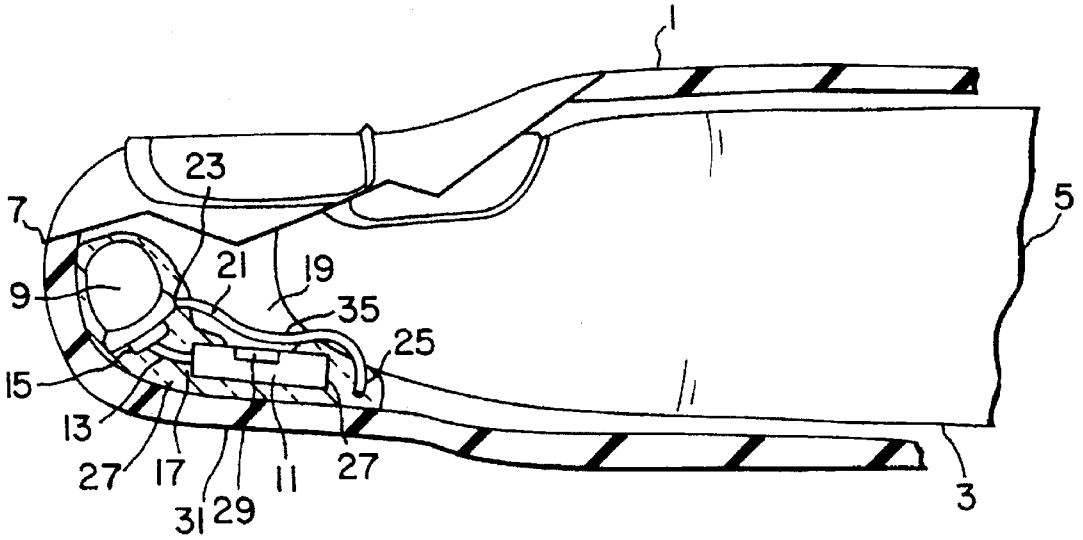
FIG. 1 is a sectional view showing an embodiment of the present invention.

In accordance with the present invention there is provided a pressure actuated light comprising a housing means having an open end into which a human digit can be inserted, and a closed end adapted to transmit light; and an illuminating system located proximally to said closed end, comprising a light source adjacent said closed end; a battery to provide electrical power to said light source; means for making a permanent electrical connection between one terminal of said light source and a corresponding terminal of said battery; and actuating means comprising a conductor means with one end thereof having a permanent electrical connection to the opposite terminal of said light source, and with the opposite end or intervening portion thereof located proximally to the corresponding opposite terminal of said battery, whereby said conductor means, in cooperation with said inserted human digit and said housing means, is capable of making an intermittent and interruptible electrical connection between said opposite terminal of said light source and said corresponding opposite terminal of said battery.

Use of the pressure actuated light of the present invention is very straightforward, and will depend upon whether the housing means is relatively flexible and resilient, in which case the conductor means component of the actuating means should be relatively rigid; or whether the housing means is relatively rigid, in which case the conductor means component of the actuating means should be relatively flexible and resilient. Accordingly, when said human digit is properly inserted into said housing means which is relatively flexible and resilient, an insubstantial pressure applied to the outside surface of said housing means in an area adjacent to said battery will cause said conductor means, which is relatively rigid, to come into contact with said corresponding opposite terminal of said battery, thereby completing an electrical circuit between said light source and said battery, causing said light source to emit light through said closed end of said housing means; and when said insubstantial pressure is released, said rigid conductor means will come out of contact with said corresponding opposite terminal of said battery, thereby breaking said electrical circuit between said light source and said battery, causing said light source to stop emitting light. On the other hand, when said human digit is properly inserted into said housing means which is relatively rigid, an insubstantial pressure applied to said conductor means, which is relatively flexible and resilient, will cause said conductor means to come into contact with said corresponding opposite terminal of said battery, thereby completing an electrical circuit between said light source and said battery, with the same above-described consequences. Variations of the above-described scenarios are also contemplated to be within the scope of the present invention.

In accordance with the present invention there is further provided a pressure actuated light as described above in which the human digit is a thumb; the housing means is relatively flexible and resilient, or is relatively rigid, or is anything in between, and is a substantially hollow single piece molded from a flesh colored material so as to closely resemble a human thumb; which additionally includes a nonconductive encasing means enclosing at least the light source component of the illuminating system; in which the conductor means with one end thereof having a permanent electrical connection to the opposite terminal of said light source, has the opposite end thereof permanently anchored in said nonconductive encasing means; the light source is a light emitting diode (LED) tinted to provide color; the battery is an alkaline cell 625 or NiCd battery; the means for making a permanent electrical connection between one terminal of said light source and a corresponding terminal of said battery is an electrical wire; the actuating means is a relatively flexible and resilient, or a relatively rigid electrical wire; the encasing means is a synthetic polymer material which is transparent or translucent when said light source is optionally covered thereby; and said encasing means additionally serves to anchor said illuminating system to said housing means.

DETAILED DESCRIPTION OF THE INVENTION

The pressure actuated light of the present invention can be used in a number of different applications, several of which have already been described above in the discussion of the background of the present invention. For example, the closed end of the housing means adjacent the light source can be made of a transparent material, or can have a transparent material inserted therein, or can actually be open, in which case it would be referred to as the substantially closed end of the housing means. When the closed end of the housing means is adapted in this manner, substantial amounts of light will be transmitted therefrom, and the pressure actuated light of the present invention can be used to illuminate difficult to see objects while the hands of the user remain free to accomplish the task at hand. Thus, for the purpose of inserting a key into a lock in order to open a door, etc., at night or under conditions of poor visibility, the pressure actuated light source of the present invention would be ideal, since it requires an insubstantial amount of pressure to actuate the light source, which will continue to emit light as long as such insubstantial pressure is applied to the housing means. This would pertain to the use of a key where the digit is preferably the thumb of the user, and the key is held between the thumb and the index finger.

The pressure actuated light of the present invention can also be used in applications relating to safety. For example, in riding a bicycle at night or during conditions of poor visibility, the pressure actuated light of the present invention, especially if worn on both of the user's thumbs, would provide excellent illumination for safety purposes, since the housing means would be pressed against the handlebars of the bicycle while in use. This application would also find use for safety illumination during walking, jogging or running at night or during conditions of poor visibility, where the user would merely have to press the housing means into which each of the user's thumbs had been inserted, against the opposing fingers in order to obtain the desired amount of illumination. Such a positioning of the thumbs and fingers is not difficult, but is, rather, a very natural one.

Despite all of the advantageous applications to which the pressure actuated light of the present invention may be put, as described above, as well as others that would be readily apparent to the reader, the preferred application of the present invention is to the enhancement of theater performances, and especially to the presentations of professional and amateur magicians. Magicians are performers who specialize in presenting tricks of illusion and sleight of hand that are intended to convey the impression that they are the result of extraordinary power or influence seemingly from a supernatural source, which is being exercised by the magician. In the context of such an application, the pressure actuated light of the present invention achieves especially beneficial results.

For use in the presentation of performances by magicians, the pressure actuated light of the present invention, the housing means is preferably a substantially hollow single piece molded from a flexible material so as to closely resemble a human thumb. By applying a slight pressure with the index and second fingers to the tip of the thumb of the user which has been inserted into said housing means, the illuminating system is activated and the light source emits light through the housing means. By releasing this slight pressure, the light goes off. Because the housing means is molded from a material which will permit it to closely resemble a human thumb, the light shining through that housing means will appear substantially red in color, much as it would appear when shining through a human thumb, as a result of the red blood circulating through said thumb. Thus, the magician, by simulating a plucking action with his or her hand, will appear to be plucking a light out of thin air, or from any place which the magician desires.

By simply adhering to the basic rules of performing magic tricks, e.g., keep movements natural in appearance, avoid keeping the hands still for long periods, shield the thumb tip, i.e., the housing means of the pressure actuated light, from the view of spectators whenever possible, and expose only the tip of the housing means which is the source of the light, it is possible to produce some extraordinarily powerful reactions among the spectators. The simplest effect uses one pressure actuated light and consists of appearing to pluck a light out of thin air, and then by means of a false transfer to the other hand, of making it vanish. Another effect involves the use of a pressure actuated light on both thumbs, and cupping one hand palm up in order to illuminate objects balanced on top of the pressure actuated light of the present invention. An object such as an ice cube, a piece of crystal, or a translucent ball provides an astonishing effect on which a magician's performance can be based. For example, such a routine may begin with the magician holding a drink from which an ice cube is then removed. Balancing the ice cube on top of a palm up hand with the tip of the pressure actuated light concealed under the ice cube, the magician blows gently on the ice cube, which appears to begin to glow red. The magician then reaches over with his or her empty hand and appears to pluck the light from the ice cube, shows it to the audience, tosses it back into the ice cube, blows it out, and then hands out the ice cube for inspection by the amazed spectators.

Turning now to FIG. 1 of the drawings in order to provide a further detailed description of the pressure actuated light of the present invention, it will be seen that it comprises a housing means 1 having an open end 3 into which a human digit 5 can be inserted, and a closed end 7 adapted to transmit light. The pressure actuated light further comprises an illuminating system comprising a light source 9 adjacent said closed end, a battery 11 to provide electrical power to the light source 9, and means for making a permanent electrical connection 13 between one terminal 15 of the light source 9 and a corresponding terminal 17 of the battery 11.

One of the key features of the pressure actuated light of the present invention is the actuating means 19, which comprises a rigid conductor means 21 with one end thereof having a permanent electrical connection to the opposite terminal 23 of the light source 9, and with the opposite end thereof permanently anchored at 25 in a nonconductive encasing means 27. The rigid nature of the conductor means 21, and the positioning of the human digit 5 behind it, combined with the flexible and resilient nature of the materials from which the housing means and encasing material are made, there results an intermittent and interruptible electrical connection between the opposite terminal 23 of the light source 9 and the corresponding opposite terminal 29 of the battery 11, which is usually controlled by the human digit.

When the human digit, preferably a thumb 5, is properly inserted into the housing means 1, it will, as shown, come to rest against the rigid conductor means 21. The application of an insubstantial pressure to the outside surface of the housing means 1 in an area 31 adjacent to the battery 11, will cause the rigid conductor means 21 to come into contact with the corresponding opposite terminal 29 of the battery 11, thereby completing an electrical circuit between the light source 9 and the battery 11. This insubstantial pressure is usually applied simply by way of the user pushing the housing means 7 against a hard surface (not shown). Since the digit 5, conductor means 21 and hard surface are all relatively hard and inflexible, the result is that the only flexible and resilient components involved, the housing means 7 and encasing means 27 having the battery 11 enclosed therein, will be forced to move and will become sandwiched between the hard surface and conductor means 21 until the battery 11 contacts the latter. Once this electrical circuit has been completed, it will permit the electrical energy from the battery 11 to flow through the light source 9, causing the light source 9 to emit light through the closed end 7 of the housing means 1. When the insubstantial pressure is no longer being applied, the rigid conductor means 21 will come out of contact with the corresponding opposite terminal 29 of the battery 21, thereby breaking the electrical circuit between the light source 9 and the battery 11, causing the light source 9 to stop emitting light.

The final element of which the pressure actuated light of the present invention is comprised is the nonconductive encasing means 27 which encloses all of the illuminating system except for the opposite terminal 29 of the battery 11, the portion 35 of the rigid conductor means 21 which makes electrical contact with the opposite terminal 29 of the battery 11, and optionally, the light source 9. When the light source 9 is optionally covered by the encasing means 27, the material from which said encasing means is made will be a transparent or translucent composition, so that the light emitted by the light source 9 is not prevented from passing through the housing means 7.

Figure 2:
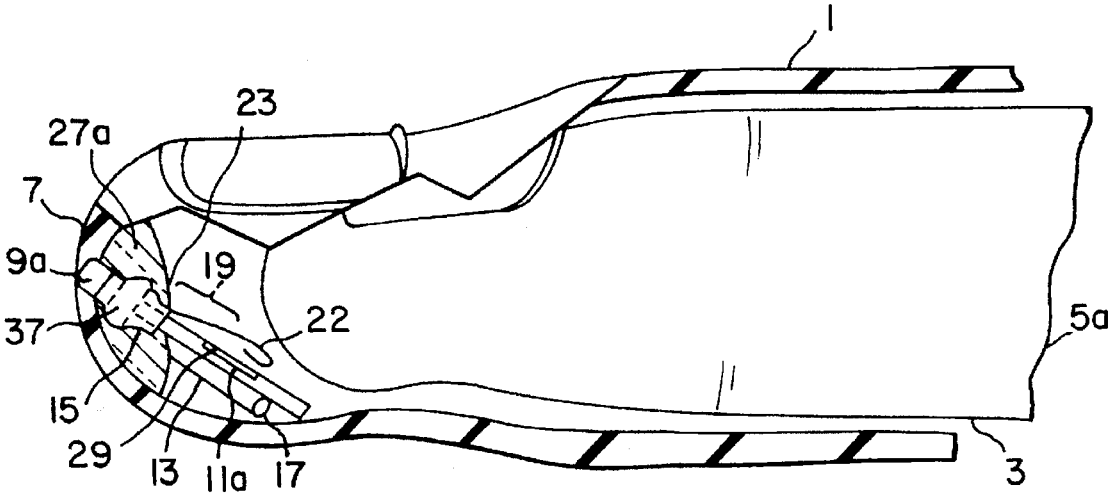
FIG. 2 is another sectional view showing a different and preferred embodiment of the present invention.

FIG. 2 illustrates a preferred embodiment of the present invention. It comprises a housing means 1 which, although somewhat flexible, is relatively rigid, and has an open end 3 into which a human thumb **5*a* can be inserted, and a closed end 7 adapted to transmit light. The light source 9*a* adjacent said closed end is a red LED, and the battery 11*a* is a thin NiCd cylinder approximately the size and shape of a U.S. penny. The means for making a permanent electrical connection 13 between one terminal 15 of the LED 9*a* and the negative terminal 17 of the battery 11*a* is an electrical wire soldered to the battery at 17. The actuating means 19 comprises a relatively flexible and resilient conductor means 22 with one end thereof having a permanent electrical connection to the opposite terminal 23 of the LED 9*a*. The conductor means is soldered at 23, but this is not shown because of the covering nonconductive material 37 which surrounds the base of the LED 9*a*, as well as the portion of the battery 11*a* adjacent thereto which comprises the negative terminal 17 of said battery. This is to prevent inadvertent contact between the conductor means 22 and the negative terminal 17. The opposite end of conductor 22 is coiled slightly as shown, in order to better accommodate the end of thumb 5*a*. As shown, it is suspended in air, but the flexible and resilient nature of the conductor means 22, combined with the relatively rigid nature of the materials from which the housing means is made, makes it possible to produce an intermittent and interruptible electrical connection between the opposite terminal 23 of the LED 9*a* and the corresponding positive terminal 29 of the battery 11*a***.

When the human thumb **5*a*, is properly inserted into the housing means 1, it will, as shown, come to rest against the relatively flexible and resilient conductor means 22. The application of an insubstantial pressure to said conductor means will cause it to come into contact with the corresponding positive terminal 29 of the battery 11*a*, thereby completing an electrical circuit between the LED 9*a* and the battery 11*a*. This insubstantial pressure is usually applied simply by way of the user pushing against the bottom of the housing means 7, which is relatively hard. The result is that only the flexible and resilient component, the conductor means 22, will be forced to move and will become sandwiched between the thumb 5***a* and the battery 11*a*, until it contacts the latter. Once this electrical circuit has been completed, it will permit the LED 9*a* to emit light through the closed end 7.

The nonconductive encasing means 27*a*, which encloses at least the LED 9*a*, is made of a silicone polymer, which is a transparent or translucent composition, so that the light emitted by the LED 9*a*, which is red, will be transmitted throughout said silicone polymer, thereby in effect becoming magnified, so that when it passes through the closed end 7 of the housing means 1, it will appear as a large red glow. When the insubstantial pressure is no longer being applied, the conductor means 22 will come out of contact with the corresponding positive terminal 29 of the battery 21*a*, thereby breaking the electrical circuit between the LED 9*a* and the battery 11*a*, causing the LED 9*a* to stop emitting light.

There will now be described in more detail various alternative embodiments of the pressure actuated light of the present invention, many of which will have become apparent to the artisan after the above set forth description of the present invention. For example, the housing means, which may be anywhere from relatively flexible and resilient to relatively rigid, is preferably molded from a natural or synthetic polymer or elastomeric composition which will give the desired properties. The expression "rigid" as used herein means that the housing means must not move easily in response to pressure, that it is hard, stiff, and unyielding. The expression "flexible and resilient" as used herein with reference to either the housing means or the conductor means, is intended to denote that, with respect to the housing means, that the housing means must move easily in response to pressure, and must easily resume its former position once that pressure is released. It is also preferred that the housing means closely resemble the human thumb, so that when the user's thumb is inserted into the open end of the housing means, a snug fit will be achieved and the result will be a very natural appearing thumb. The compositions from which the housing means is preferably fabricated also have the advantage of being translucent, so that it is usually not necessary to go to the extra expense of providing an insert in the housing means, although this is certainly within the scope of the present invention.

Although not preferred, it is possible to carry out the molding of the housing means in such a way that a plurality of substantially circumferential ribs is created on the inner surface of the housing means, which consist of areas of extra thickening of the walls of the housing means. In this way the housing means circumference can be made smaller and then stretched over the thumb or other digit of the user, with the ribs creating a gripping surface. While it is preferred that the housing means resemble a human thumb because of the preferred use of the pressure actuated light in magicians' performances, as explained further above, it is nevertheless within the scope of the present invention to have the housing means resemble other human digits such as the ring finger. Such housing means may well be suitable for other applications of the present invention, also explained further above. Finally, the size of the housing means is well within the skill of the artisan. As to circumference, it may be desirable to have the housing means available in a number of different sizes, since even young children may give performances, and it is unlikely that one size of housing means would fit both a child and an adult. As to the length of the housing means, it is desirable that it be long enough so that it is not readily apparent to spectators in an audience, and yet not so long that it creates difficulties in putting it on and taking it off, which would be especially important during a performance. Here again, it may be desirable to make the housing means available in a variety of sizes.

The illuminating system of the pressure actuated light has several components. The first of these is the light source, which most conveniently, and preferably, will be a light emitting diode (LED), which provides a sufficient amount of light for the desired result, and which does not generate enough heat to cause discomfort to the user or substantial damage to the other components of the illuminating system or the housing means. It is preferred to use a T 1¾ light emitting diode (LED) of the superb right type, which has an illumination intensity of from about 500 mcd to about 3000 mcd, and which may have a clear or lightly tinted envelope. It is preferred to use tinted envelopes to generate green, yellow and red light. The LED may also have a narrower field of illumination, e.g., 20° to 30°, in order to provide spot intensity for some desired use. In another embodiment of the present invention, an LED with three electrical leads which generates two different colors is used. In this embodiment, two rigid conductor means are used. When pressure is applied to complete a circuit between the opposite terminal of the battery and a first opposite terminal of the LED light source, a green light is emitted. When further pressure is applied to complete a circuit between the opposite terminal of the battery and a second opposite terminal of the LED light source, a red light is also emitted, but overwhelms the green light so that it appears to be red. Nevertheless, despite the many advantages inherent in the use of a LED light source, it will again be apparent to the artisan that other light sources can be substituted for such an LED and are thus within the scope of the present invention. For example, it would be possible to use an incandescent bulb, although this type of light source requires too much amperage to be useful, as a rule. Other light source alternatives would be obvious to the artisan.

The source of electrical power in the illuminating system is the battery. The only requirement is that the battery be capable of providing sufficient electrical power to enable the light source to emit light, preferably for a period of time which will make it suitable for use in performances. Accordingly, the battery should be compatible in terms of both voltage and amperage with the light source. Because of the spatial constraints created by the housing means and the required juxtaposition of the inserted digit and the actuating means and other components of the illuminating system, a small battery is required, and consequently a small, powerful battery is preferred. Such batteries are commercially available for powering wristwatches, cameras and other electronic devices, and include alkaline 625 cells and NiCd batteries. These are also convenient in terms of shape, being cylindrical with an acceptable diameter and a usable height. For example, the preferred battery for use in the actuated light of the present invention is approximately the size and shape of a U.S. penny. One terminal, e.g., the negative terminal, of the battery is connected to the corresponding terminal of the light source by means of a permanent electrical coupling, preferably an electrical wire of the type commonly available. It will be understood that the light source is usually energized regardless of the direction of current flow, which is the case with an incandescent bulb. However, where polarity of the current is critical, which may be the case with a LED, the artisan will know to take care to ensure that the proper battery terminals and corresponding light source terminals are connected.

The actuating means of the pressure actuated light comprises a relatively flexible and resilient, or a relatively rigid conductor means with one end thereof having a permanent electrical connection to the opposite terminal of the light source. The expression "rigid" as used herein means that in addition to being electrically conductive, the actuating means must not move easily in response to pressure, that it must be hard, stiff, and unyielding. The expression "flexible and resilient", on the other hand, is intended to denote that, with respect to the conductor means, that the conductor means must move easily in response to pressure, and must easily resume its former position once that pressure is released.

As with the housing means, which may be anywhere from rigid to flexible and resilient, or anything in between, which is intended to encompassed by the terms "relatively rigid" and "relatively flexible and resilient", the conductor means may be either rigid or flexible and resilient, or anything in between. However, it will be appreciated from the description herein, that there is substantially a reciprocal relationship between the character of the housing means, i.e., whether it is rigid or flexible and resilient, and the corresponding character of the conductor means. Thus, when the housing means is "relatively rigid", the conductor means should be "relatively flexible and resilient"; and when the housing means is "relatively flexible and resilient", the conductor means should be "relatively rigid".

A preferred example of rigid conductor means is a reasonably thick electrical wire made of copper, silver or preferably some other metal or alloy which meets the rigidity criteria set out above. A preferred example flexible and resilient conductor means is a relatively thin wire made of silver or preferably some metal or alloy which will provide the desired property of being flexible and resilient, while also being conductive. The opposite end of the conductor means may be permanently anchored in the nonconductive encasing means. However, it is preferred, where the conductor means is flexible and resilient, that it simply be suspended in air, i.e. , that it not be in contact with any part of the illuminating system. It is also preferred that the end of the conductor means be coiled slightly so as to make a broader surface against which the thumb of the user can come to rest, and so as to avoid the possibility of having the end of the conductor means pierce the thumb of the user. The nonconductive encasing means should have properties with respect to rigidity and flexibility which are similar to those of the housing means. Preferably, however, a flexible and resilient material will be used; and it is also preferred that the material be transparent or translucent, so as to enhance the transmission of light from the light source through the end of the housing means.

Where the conductor means is relatively flexible and resilient, its pliable and movable nature, in cooperation with the hard and unyielding nature of the complementary, relatively rigid housing means and the human digit resting behind it, are capable of making an intermittent and interruptible electrical connection between the opposite terminal of the light source and the corresponding opposite terminal of the battery. When an insubstantial, i.e., a very slight amount of pressure is applied to the surface of the conductor means, the force thus applied pushes or moves the conductor means into contact with the battery, so as to complete an electrical circuit between the battery and the light source. When the pressure is released, the flexible and resilient nature of the material from which the conductor means is made will result in the conductor means resuming its former position, thereby coming out of contact with the battery and breaking the electrical circuit which had been established.

Where the conductor means is relatively rigid, its rigid nature and that of the human digit resting behind it, in cooperation with the movable nature of the complementary flexible and resilient housing means, are capable of making an intermittent and interruptible electrical connection between the opposite terminal of the light source and the corresponding opposite terminal of the battery. When an insubstantial, i.e., a very slight amount of pressure is applied to the surface of the housing means adjacent the location of the battery, the force thus applied pushes or moves the battery against the rigid conductor means so as to complete an electrical circuit between the battery and the light source. The human digit which is inserted into the housing means and is at rest against the rigid conductor means, serves the purpose of maintaining these in position while the battery is being forced into contact against the rigid conductor means. When the pressure is released, the flexible and resilient nature of the material from which the housing means is made will result in the battery resuming its former position, thereby coming out of contact with the rigid conductor means and breaking the electrical circuit which had been established.

In another preferred embodiment of the present invention, a nonconductive covering is placed over the point where the conductor means is soldered or otherwise electrically affixed to the LED, as well as the portion of the negative terminal of the battery which is adjacent to that location. Only a portion of the negative terminal of the battery is covered, because in this type of round battery the negative terminal is usually around the outer circumference of the battery, while the center of the battery comprises the positive terminal. This covering of nonconductive material may also surround the base of the LED, as well as the point at which the permanent electrical connection from the negative terminal of the battery is soldered or otherwise electrically affixed to the LED. The purpose of the nonconductive covering is to prevent inadvertent contact between the conductor means and the negative terminal of the battery, as well as to insulate other points in the illuminating system which might come in contact with the human digit inserted in the housing means. In a particularly preferred embodiment, this nonconductive covering is made from the types of materials commonly used in making electrical connections commercially, and referred to commonly as shrink tubes. These devices are tubes or strips of various sizes made from insulating synthetic polymer materials which will contract permanently under the application of heat. These are materials are simply placed over the areas which it is desired to cover, after which moderate heat is applied, and the material contracts permanently around the area.

The last component of the illuminating system of the pressure actuated light of the present invention is the encasing means, which structurally and functionally bridges the housing means and the illuminating system. First of all, the encasing means must be nonconductive. The need for this is self-evident, and relates to the contact which must be made by the human digit inserted into the housing means with the electrically active components of the illuminating system, as well as the possibility of a short circuit which would destroy or severely damage the illuminating system. It also relates to the generation of heat as well as light by the light source, the discomfort and adverse effects of which can be largely avoided by enclosing the components of the illuminating system, especially the light source, within the encasing means. The only portion of the illuminating system which must not be enclosed by the encasing means is the opposite terminal of the battery and the portion of the rigid conductor which must come into contact with it. In the preferred embodiments of the present invention, however, where the light source is a LED, and there is, consequently, no significant amount of heat given off, the encasing means serves the preferred purpose of enhancing the lighting effect of said LED.

Although optional, it is highly desirable that the encasing means be anchored to the housing means. This will ensure uniformity of results when the pressure actuated light of the present invention is used in the various applications described above. This anchoring can be accomplished by the use of a separate adhesive between the encasing means and the housing means, but it is more expedient, and therefore preferred, that the composition from which the encasing means is made be such that it has initial adhesive properties whereby it can be anchored to the housing means, and thereafter form a secure adhesive bond thereto upon curing or solidifying. Thus, it is generally preferred that the encasing means be made from a synthetic or natural polymer or elastomeric composition which is flexible and resilient. In particular, it is preferred to use a polysiloxane, i.e., a silicone polymer composition for making the encasing means.

What is claimed is:

1. A pressure actuated light comprising:

1) housing means having an open end into which a human digit can be inserted, and a closed end adapted to transmit light; and 2) an illuminating system located proximally to said closed end, comprising:

a) a light source adjacent said closed end;

b) a battery to provide electrical power to said light source;

c) means for making a permanent electrical connection between one terminal of said light source and a corresponding terminal of said battery; and d) actuating means comprising: conductor means with one end thereof having a permanent electrical connection to the opposite terminal of said light source, and with the opposite end or intervening portion thereof located proximally to the corresponding opposite terminal of said battery, whereby said conductor means, in cooperation with said inserted human digit and said housing means, is capable of making an intermittent and interruptible electrical connection between said opposite terminal of said light source and said corresponding opposite terminal of said battery.

2. A pressure actuated light according to claim 1 wherein said housing means relatively flexible and resilient and said conductor means is relatively rigid; and wherein when said human digit is properly inserted into said relatively flexible and resilient housing means, an insubstantial pressure applied to the outside surface of said housing means in an area adjacent to said battery will cause said relatively rigid conductor means to come into contact with said corresponding opposite terminal of said battery, thereby completing an electrical circuit between said light source and said battery, causing said light source to emit light through said closed end of said housing means; and wherein when said insubstantial pressure is released, said relatively rigid conductor means will come out of contact with said corresponding opposite terminal of said battery, thereby breaking said electrical circuit between said light source and said battery, causing said light source to stop emitting light.

3. A pressure actuated light according to claim 1 wherein said housing means relatively rigid and said conductor means is relatively flexible and resilient; and wherein when said human digit is properly inserted into said relatively rigid housing means, an insubstantial pressure applied to said relatively flexible and resilient conductor means, will cause said relatively flexible and resilient conductor means to come into contact with said corresponding opposite terminal of said battery, thereby completing an electrical circuit between said light source and said battery; and wherein when said insubstantial pressure is released, said relatively flexible and resilient conductor means will come out of contact with said corresponding opposite terminal of said battery, thereby breaking said electrical circuit between said light source and said battery, causing said light source to stop emitting light.

4. A pressure actuated light according to claim 1 wherein said closed end of said housing means has an opening therein adjacent to said light source and sufficient in size to transmit light from said light source directly through said opening in said housing means to the outside surroundings of said housing means.

5. A pressure actuated light according to claim 4 wherein said opening in said closed end of said housing means has a transparent material inserted therein.

6. A pressure actuated light according to claim 1 additionally including nonconductive encasing means which encloses at least said light source component of said illuminating system, and is transparent or translucent.

7. A pressure actuated light according to claim 6 wherein said encasing means encloses all of said illuminating system, except said opposite terminal of said battery and the portion of said conductor means which must come into contact therewith.

8. A pressure actuated light according to claim 6 wherein said encasing means is attached to said housing means by means of a separate adhesive between said encasing means and said housing means, or by means of the initial adhesive properties of the material from which said encasing means is prepared, whereby it can be attached to said housing means, and thereafter form a secure adhesive bond thereto upon curing or solidifying.

9. A pressure actuated light according to claim 8 wherein said encasing means be prepared from a synthetic or natural polymer or elastomeric composition which is flexible and resilient.

10. A pressure actuated light according to claim 9 wherein said encasing means is prepared from a polysiloxane or silicone polymer composition which is transparent or translucent when said light source is covered thereby.

11. A pressure actuated light according to claim 1 additionally including nonconductive covering means placed over the area where said one end of said conductor means has a permanent electrical connection to said opposite terminal of said light source, and to the portion of said corresponding terminal of said battery which is adjacent to said area; and optionally surrounding the base of said light source, as well as the area where said permanent electrical connection from said corresponding terminal of said battery is electrically affixed to said light source.

12. A pressure actuated light according to claim 1 wherein said human digit is a thumb, and said housing means is a substantially hollow single piece molded from a flesh colored material so as to closely resemble a human thumb.

13. A pressure actuated light according to claim 1 wherein said light source is a light emitting diode (LED).

14. A pressure actuated light according to claim 13 wherein said LED has three electrical leads whereby it can generate two different colors comprising: two rigid conductor means such that when pressure is applied to complete a circuit between said opposite terminal of said battery and a first said opposite terminal of said LED light source, a light of a first color is emitted; and when further pressure is applied to complete a circuit between said opposite terminal of said battery and a second said opposite terminal of said LED light source, a light of a second color is also emitted.

15. A pressure actuated light according to claim 14 wherein said first color is green and said second color is red, and said light of a red color overwhelms said light of a green color, so that said light emitted by said pressure actuated light appears to be red.

16. A pressure actuated light according to claim 1 wherein said battery is an alkaline cell 625 or NiCd battery.

17. A pressure actuated light according to claim 1 wherein said means for making a permanent electrical connection between said one terminal of said light source and said corresponding terminal of said battery is an electrical wire.

18. A pressure actuated light according to claim 1 wherein said actuating means is a flexible and resilient electrical wire.

19. A pressure actuated light according to claim 1 wherein said housing means has digit gripping means on the inner surface thereof comprising a plurality of substantially circumferential ribs.

20. An illuminating system for use in a housing means adapted to transmit light comprising:

a) a light source comprising: a light emitting diode (LED);

b) a battery to provide electrical power to said light source;

c) means for making a permanent electrical connection between one terminal of said light source and a corresponding terminal of said battery;

d) actuating means comprising: conductor means with one end thereof having a permanent electrical connection to the opposite terminal of said light source, and with the opposite end or intervening portion thereof located proximally to the corresponding opposite terminal of said battery, whereby said conductor means is capable of making an intermittent and interruptible electrical connection between said opposite terminal of said light source and said corresponding opposite terminal of said battery; and e) nonconductive covering means applied to:

i) the area wherein said one end of said conductor means has a permanent electrical connection to said opposite terminal of said light source;

ii) the portion of said corresponding terminal of said battery which is adjacent to said area;

iii) the area surrounding the base of said light source; and iv) the area wherein said permanent electrical connection from said corresponding terminal of said battery is electrically affixed to said light source.

* * * * *